United States Patent [19]

Pallasch et al.

[11] Patent Number: 4,993,547

[45] Date of Patent: Feb. 19, 1991

[54] STACKABLE PIGGY-BACK CARTON FOR BASKETBALL BACKBOARD AND RIM

[75] Inventors: James Pallasch, Wheaton; Robert Floresch, Sycamore, both of Ill.

[73] Assignee: Porter Athletic Equipment Company, Schiller Park, Ill.

[21] Appl. No.: 446,448

[22] Filed: Dec. 5, 1989

[51] Int. Cl.[5] ..... B65D 85/20

[52] U.S. Cl. ..... 206/315.1; 206/45.14; 206/482; 206/491

[58] Field of Search ..... 206/45.14, 45.31, 462, 206/476, 477, 482, 486, 487, 491, 492, 315.1, 579

[56] References Cited

U.S. PATENT DOCUMENTS

| | | | |
|---|---|---|---|
| 1,011,697 | 12/1911 | Witkowski | 206/462 |
| 1,643,421 | 9/1927 | Rowan | 206/482 |
| 2,018,861 | 10/1935 | Mertz | 206/44.11 |
| 2,122,588 | 7/1938 | Ruff . | |
| 2,681,174 | 6/1954 | Bergstein . | |
| 2,843,307 | 7/1958 | Goltz . | |
| 2,878,933 | 3/1959 | Sager | 206/482 |
| 2,913,162 | 11/1959 | Goltz . | |
| 3,130,833 | 4/1964 | Glasser et al. | 206/482 |
| 3,187,889 | 6/1965 | Sinclair . | |
| 3,233,725 | 2/1966 | Bixler | 206/45.14 |
| 3,241,738 | 3/1966 | Freiman . | |
| 3,294,233 | 12/1966 | Nollinger . | |
| 3,324,999 | 6/1967 | Fanquhar . | |
| 3,545,664 | 12/1970 | Robinson | 206/303 |
| 3,637,130 | 1/1972 | Farquhar . | |
| 3,872,966 | 3/1975 | Gordon et al. . | |
| 4,039,077 | 8/1977 | Sorenson | 206/476 |
| 4,365,714 | 12/1982 | Doyel | 206/491 |
| 4,511,037 | 4/1985 | Lucous | 206/303 |
| 4,653,646 | 3/1987 | Allen et al. . | |

*Primary Examiner*—David T. Fidei

*Attorney, Agent, or Firm*—Barnes & Thornburg

[57] ABSTRACT

A piggy-back package for holding a basketball backboard and rim with positioning tabs on the package of the basketball backboard, which tabs position and hold a rim package on the backboard package. The rim package is off-set and at one end of the backboard to allow for tight stacking of two piggy-back packages (one upside down and rotated 180° from the other).

25 Claims, 2 Drawing Sheets

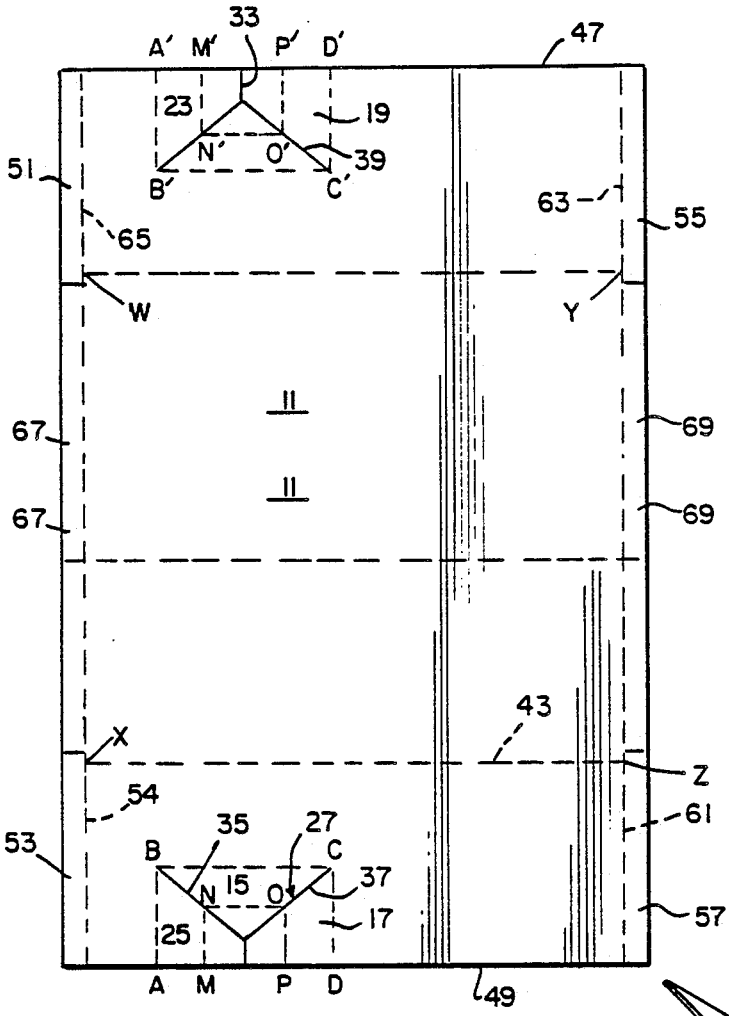
FIG. 3
FIG. 3
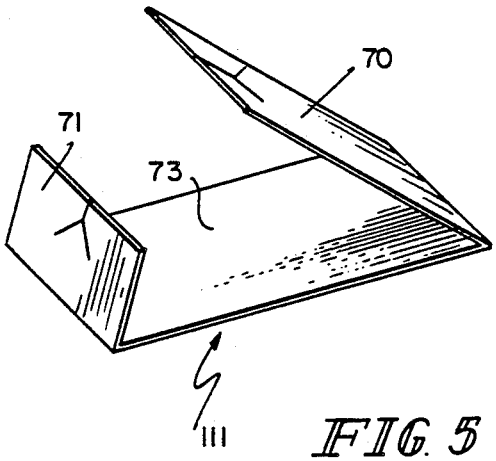
FIG. 5
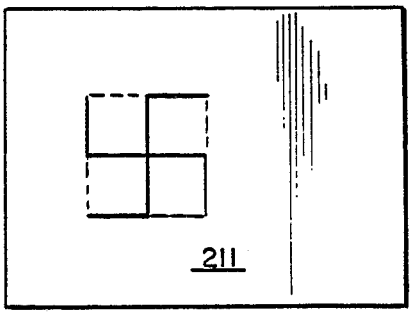
FIG. 6
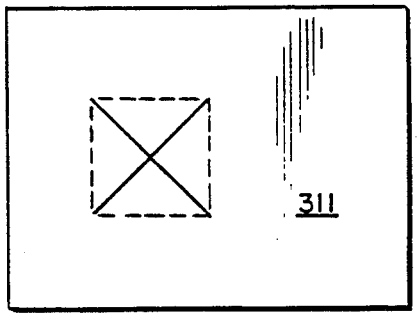
FIG. 7

STACKABLE PIGGY-BACK CARTON FOR BASKETBALL BACKBOARD AND RIM

BACKGROUND AND SUMMARY OF THE INVENTION

The invention is directed to a stackable carton for separately packaging a basketball backboard and a basketball rim into a single carton which can also be used to package the basketball backboard by itself.

In the past basketball backboards and their rims were each separately packaged and shipped to retailers as two separate items. First time consumers buying a rim and backboard prefer a single package or unit. This is also a desirable and effective marketing technique for the retailers.

Additionally, it has been known to ship basketball backboards, rims and supports in a single carton, see U.S. Pat. No. 4,653,646 to Allen, et al. issued Mar. 31, 1987. This Allen, et al. package has the disadvantage that it takes up a considerable amount of storage space and requires internal spacers to keep the rims from sliding around in the package and is especially wasting of space when only a backboard is shipped. Therefor normally a different box is used for the three-in-one construction than when the backboard alone is shipped.

The instant invention relates to a carton which can handle a single backboard by itself in a compact manner and without spacers, or alternatively can contain both a basketball backboard and its rim in a single unitary package. The carton has a stacking feature which allows two combined packages (each containing a backboard and rim) to be stacked in a manner to take up approximately the same amount of space as one package of the above-mentioned Allen, et al. type. Thus the instant invention is not only saving of space, but is cheaper to use since it requires inventorying one shipping carton or package and can be used without spacers to ship a backboard by itself.

This double purpose use limits the different number of cartons a manufacturer has to stock, since the same carton is used whether or not a basketball rim is shipped with a backboard.

The compact piggy-back stacking arrangement is obtained by mounting the rim package on one side of the basketball backboard carton such that the rim package is located between an end of the backboard carton and its midpoint. In this manner two cartons can be piggy-backed one on top of the other by rotating one package 180° horizontally and placing it atop the other package in an inverted manner so as to create a sandwich structure with the two backboard portions acting as the bread and the two rim packages acting as the sandwich filler, located side by side.

The carton has location means on one side for securing the rim package. This location means comprises tabs which are scored into a carton blank and which can be lifted up to securely position and hold the rim package. There are two scorings to create the tabs.

Each scoring is preferably, but not necessarily located along two opposing edges of the carton blank when it is flat and is "Y" shaped. The stem of the "Y" abuts an edge of the carton and the "V" portion of the "Y" opens toward the center of the carton. The type of scoring allows for some overlapping of the edges of the carton blank when it is folded about a backboard so as to accommodate different sized backboards in the same package and to compensate for variations in the centering of the fold that encases the backboard. Here the stem portions of the "Y" would overlap when the blank is folded. If the score lines are not located at an edge of the blank, then additional score lines will be necessary. For example six score lines to create a box divided into four quarters could produce four tabs. Here, the score lines would be in the form of a swastika. Alternatively an "X" score could produce four tabs.

Fold lines can also be impressed into the carton blank. The tabs can be long enough so that they will be first upwardly rotated 90° from the plane of the carton after the carton is folded around the backboard. The rim package is then placed between the folded out tabs and tip portions of the tabs can then be folded 90° to face one another as well as being parallel to the backboard. These tip portions would then extend over the rim package. Stapling, gluing or taping of the tips to the top of the rim package would secure it to the carton in a fixed position. The two "Y" scores produce six tabs. Two have delta configurations and correspond to the "V" portion of the "Y" score. The other four tabs are four sided and have two parallel sides joined by one right angle side formed by the edge of the carton and an acutely angled side formed by one leg of the "V" portion of the "Y" score.

It is not necessary that the tip portions of the tabs be folded over from the tab itself. Instead the once folded upright tabs could be attached to the sides of the rim basket package without folding of the tip portions.

Alternatively, only some of the tabs can be rotated 90° and the others could remain flat to provide a cushion between the rim package and the backboard if such is desired. Where glass backboards are used, this non-folding of some tabs may be advantageously used to keep the rim package from damaging the backboard, which it might do if it rested directly on the glass surface. Also with fan-shaped (curved edged) backboards, retaining one or more of the flaps flat, might help fill in a void area of the backboard package to hold the rim package horizontal for the purpose of preventing an edge thereof from gouging into the backboard. Some cutting of the tab may be necessary here. Preferably the tabs are an integral part of a paperboard (cardboard) blank that makes up the carton housing the backboard.

Other objects, advantages and novel features of the present invention will become apparent from the following detailed description of the invention when considered in conjunction with the accompanying drawings.

BRIEF DESCRIPTION OF THE DRAWINGS

FIG. 4 shows two combined piggy-back packages of FIG. 1 stacked one on another; and FIGS. 5, 6 and 7 show alternative arrangements for the carton blank.

DETAILED DESCRIPTION OF THE DRAWINGS

Figure 1:
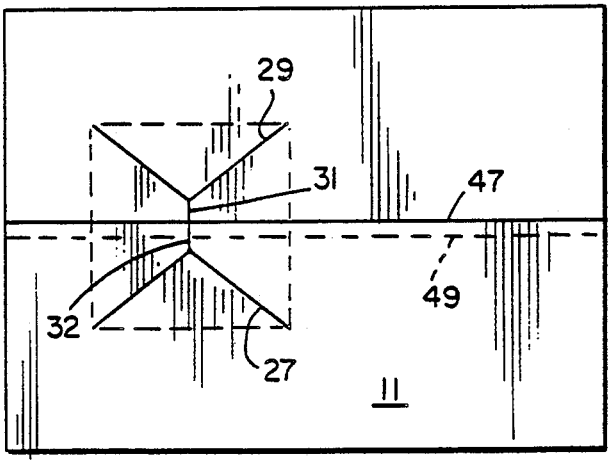
FIG. 1 shows a plan view of a folded blank prior to attachment of a rim package.
Figure 3:
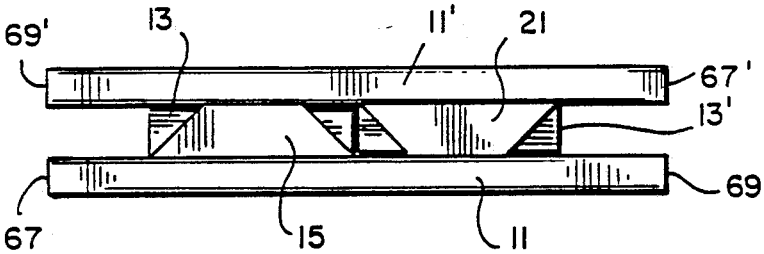
FIG. 3 shows a blank for making the backboard carton of FIG. 1.

FIG. 1 shows a double carton for a basketball backboard and basketball rim assembly in plan view. Here the carton blank of FIG. 3 is shown folded about a basketball backboard with its two Y-shaped score lines 27 and 29 visible. These Y-shaped score lines are located adjacent outer edges 47, 49 of the carton. Edge 49 is shown as being overlapped by edge 47. While the edges are shown as overlapping they could just abut one another. When the carton is to be used for shipping only a basketball backboard the Y-shaped score lines will not be severed and the package will remain flat.

Figure 2:
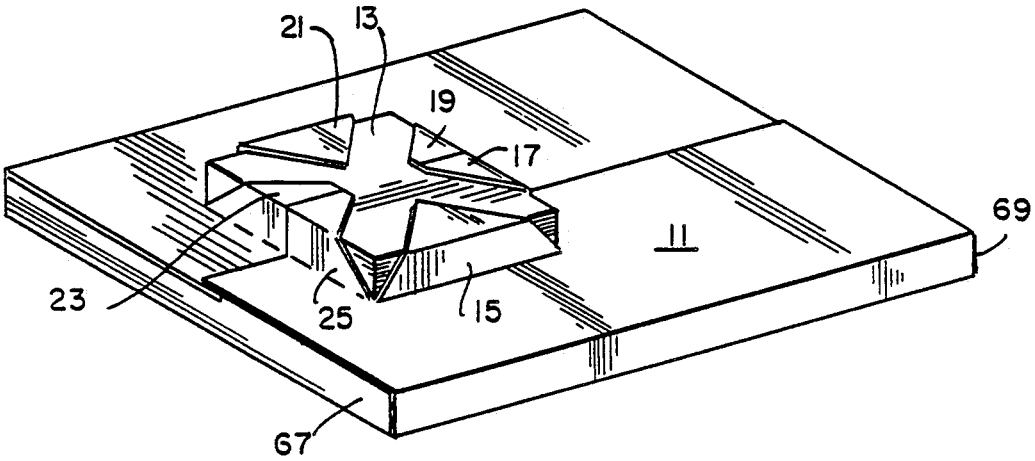
FIG. 2 shows a schematic three dimensional showing of a combined piggy-back package for a basketball backboard and rim.

When it is desired to ship both a basketball backboard and a basketball rim, the basketball backboard will be located in the package, but then the tabs formed by the two Y-shaped scores 27 and 29 will be folded outwardly of the carton 11 to provide a nesting place for a basketball rim package as shown in FIG. 2.

To obtain the package of FIG. 1 (also FIG. 2) the rectangular blank of FIG. 3 is utilized. A basketball backboard (not shown) is centrally placed on the blank such that its two longest sides lie adjacent and parallel to fold lines 43 and 45. The edges 47 and 49 of the blank are then lifted upwardly and folded around the fold lines 43 for 180° to obtain the FIG. 1 configuration. Here the base portions 31, 33 (see FIG. 3) of the two Y-shaped scores will either abut or overlap one another. The edges 47, 49 are then secured to one another and the basketball backboard is thus packaged.

FIG. 2 shows a double carton package for a basketball backboard and a basketball rim in assembled condition. The backboard is located within a first package 11 formed by the blank of FIG. 3. A second rim package 13 is held to the first package by 6 tabs 15, 17, 19, 21, 23, 25.

The tabs are obtained by creating two Y-shaped scores 27, 29 in the blank 11 as shown by solid lines in FIG. 3. The two Y-shapes have a base or stem 31, 33 and a V portion having legs 35, 37, 39, 41. The scores are slit and each tab is folded 90° about its dash line. For example tab 17 is folded along line D-C, tab 15 along line B-C, tab 25 along line B-A and tabs 19, 21 and 23 are similarly folded about the same fold lines (indicated by prime letters in FIG. 3.) Blank 11 also has folding lines 43, 45.

In assembling the package a basketball backboard is placed on top of the blank 11 between fold lines 43, 45. The edges 47 and 49 of the blank 11 are lifted upwardly and folded 360° around the fold lines 43, 45. Depending on the height of the backboard the edges 47, 49 will either abut one another or overlap. The distance between lines 43, 45 should ideally be chosen to be sized equal to the largest height backboard made. For smaller height backboards the fold lines 43, 45 can be made closer together so as to have the fold lines occur at the edges of the backboard. To this end, a plurality of fold lines could be indicated on the blank by printing. As illustrated in FIG. 3 the fold lines 43 and 45 are the axis about which the edges 47, 49 are folded through 180° regardless of the presence of printing on the carton.

After the edges have been folded over the backboard, the tabs 15, 17, 19, 21, 23 are freed by slitting or tearing along the Y-shaped score lines 27, 29 and folded upwardly along their fold lines as indicated previously. For this disclosure, score lines also include perforated lines and equivalents. After the tabs 15, 17, 19, 21, 23 have been folded upwardly, the rim package 13 is placed within the opening defined by the tabs.

If desired the end tip portions of the tab are then folded over the top of the rim package 13 as clearly shown in FIG. 2. These end tip portions (as well as the upstanding portions of the tabs) 15, 17, 19, 21, 23, 25 can be secured to the rim package such as by stapling, gluing, taping, etc. The upstanding portions of the tabs will thus position and secure the rim package in a length and width direction along the backboard and the end portions will secure the rim package vertically and against the backboard. While folding over of end tip portions provides a desired vertical securement, such is not necessary and the tabs could be made shorter and merely cover only end parts of the package 13 to which they would be secured.

As indicated previously not all of the tabs need be bent outwardly. For example, tab 25 or tabs 15 and 17, etc. could remain flat so as to provide a cushion between the rim package 13 and the backboard. Also if a fan shape backboard is being shipped any tab(s) could be pushed inwardly 180° (not shown) to provide a spacer to fill a void in the backboard package caused by the fan shape of the backboard. Here the rim package 13 would rest in part on the backboard and in part on the folded inward tab so as to remain horizontal and not have an edge dig into the backboard.

Cutouts 51, 53, 55, 57 can be provided by score lines 59, 61, 63, 65 to define end flaps 67, 69 to be folded 360° along the edge of the backboard on fold lines W-X and Y-Z to secure the backboard from sliding out of the package 11.

These piggy-back packages can be easily stored one on top of the other by turning piggy-back package 11', 13' over and rotating it by 180° so that is rim package 13' falls at the open area of the first piggy-back package 11, 13 as shown in FIG. 4. Thus storage space is considerably reduced over that provided by the Allen, et al. patent (supra).

As previously indicated the blank 11 can be used to house only backboard(s). For this purpose the flaps would remain flat and would not be opened along their score lines to fold upwardly.

Any or all of the various fold lines could be indicated by printing on the container, by depressions in the package, by weakened lines such as by some perforations, etc.

It is advantageous that the fold lines D-C, D'-C' be as close to the midpoint of the center (lengthwise) of package 11 as possible so that when the packages are stacked in inverted order (FIG. 3) the edges defined by flaps 67, 69' and 67', 69 are vertically aligned. This will provide for the smallest lengthwise nesting space and is easily obtained by having the rim package (flaps 17, 19 and 17', 19') abut one another.

While the Y-shaped scores are shown extending from the long longitudinal edges 47, 49 of the backboard blank they of course could extend from the short edges in the area of the flaps 67, 69. In this case the flaps 67 and 69 would be located along edges 47 and 49 and no cut outs 51, 53, 55, 57 would be needed thereat. However with such an arrangement it would be best to have the folding flaps that cover the backboard extend to the left and right of FIG. 3 rather than the top and bottom (see FIG. 5). Here the right hand flap 70 should be twice the length of the left hand flap 71 so that the tabs would still be off center to allow for compact stacking as shown in FIG. 4.

If end flaps are not used, then the advantages of Y-shaped scores to accommodate various sized backboards (lengths in FIG. 5) by the overlapping of the flaps would not be obtained. Here the cut outs 53, 55, 57, 59 would be provided longitudinal along the edges of the flaps 70, 71 so that the bottom portion 73 would be wider to provide a fold over flap similar to fold over flaps 67, 69 of FIG. 3.

Another advantage of having the tab Y-scores adjacent the edges of the blank is that the rear side of the carton is clear and available for printing of advertising and/or manufacturer information.

FIGS. 6 and 7 show score lines which will create four tabs to hold a basketball rim package. As shown, these score lines for the tabs are dark and the fold lines are dotted. Here the score lines are not located at the edges of the blank and thus they are symmetrical. They could be placed at the edges of the blank also in order to obtain some of the benefits of overlapping. However, upon overlapping of the edges, the score lines would not lie atop one another. This would require cutting of the score lines before the package was sealed about the backboard. With the Y-shape, the bases overlie one another so that a single cut can be made after the backboard is sealed in its carton. This is an advantage since the backboards can be sealed and stacked flat. When time for shipping occurs, the sealed package is withdrawn and if a rim package is to be piggy-backed onto the backboard package, the score lines would be cut. With edge located X-shapes and swastika shapes the package would have to be opened to get at the overlapped score lines.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A packaging carton blank for a basketball backboard and rim comprising:

a flat rectangular shaped carton blank having two parallel long sides and two parallel short sides large enough to be completely folded about the basketball backboard;

two substantially Y-shaped score lines, having a base portion starting at a pair of parallel sides and extending inwardly of the blank and a V portion whose open ends face each other across the blank and are each spaced equidistant one from the other two parallel sides of the blank;

wherein said Y-shaped scores provide tab means which can be folded 90° outwardly from a plane of the blank to provide for at least one of length and width securement of a basketball rim package on the blank.

2. A packaging carton blank according to claim 1, wherein the two Y-scores create six tabs.

3. A packaging carton blank according to claim 2, wherein at least one of the tabs has a tip portion means which is folded 90° and parallel to plane of the blank to provide vertical securement of the rim package to the blank.

4. A packaging carton blank according to claim 1, wherein at least one of the tabs has a tip portion means which is folded 90° and parallel to plane of the blank to provide vertical securement of the rim package to the blank.

5. A packaging carton blank according to claim 1, wherein the tab means provide for both length and width securement of the rim package.

6. A piggy-back packaging carton blank for a basketball backboard and rim comprising:

a flat rectangular shaped carton blank having two parallel long sides and two parallel short sides;

said flat rectangular carton blank being large enough to be wrapped about a basketball backboard;

at least two score lines on said blank to define tab means which can be folded 90° outwardly of the blank to provide securement for a basketball rim package on said blank;

said tab means being located on the blank to define a location for said securement which is located off-center of the blank, between a center line of the blank and one side of the blank; and at least one of said two score lines starting from an edge of said flat rectangular carton blank and extending inwardly from the edge towards a center of said flat rectangular carton blank.

7. A piggy-back packaging carton blank according to claim 6, wherein the tab means provide a securement for positioning the rim package both along a length and a width of a blank folded over into a package.

8. A piggy-back packaging carton blank according to claim 6, wherein the tab means have end portions which can be folded 90° to be parallel with a plane of the blank to provide vertical securement of the rim package against a blank folded over into a package.

9. A piggy-back packaging carton blank according to claim 7, wherein the tab means have end portions which can be folded 90° to be parallel with a plane of the blank to provide vertical securement of the rim package against a blank folded over into a package.

10. A piggy-back packaging carton blank according to claim 6, wherein one tab means is located at a mid-point of a package formed from a folded over blank.

11. A piggy-back packaging carton blank according to claim 6, wherein said tab means are located spaced from the edges of a package formed from a folded over blank.

12. A piggy-back packaging carton blank according to claim 6, wherein the score lines are Y-shaped.

13. A piggy-back packaging carton blank according to claim 6, wherein the score lines are X-shaped.

14. A piggy-back packaging carton blank according to claim 6, wherein the score lines are swastika shaped.

15. A piggy-back double packaging carton for a basketball backboard and rim comprising:

a first small package means of sufficient size for housing a standard basketball rim;

a second larger package means of sufficient size for housing a standard basketball backboard;

a plurality of tab means, extending outwardly from the second package means, for physically securing the first package means adjacent to one end of the second package means;

a first of said tab means being located adjacent a mid-portion of said second package means and being closer to said one end of the second package means than to an end side parallel to said one end;

a second of said tab means being located adjacent and spaced from said one end of said second package means and opposite said first tab means; and said first package means being located between said first and second tab means and secured thereto.

16. A piggy-back double packaging carton according to claim 15, wherein the tab means are integral with and a physical part of the second package.

17. A piggy-back double packaging carton according to claim 12, wherein third and fourth spaced and opposed tab means are provided and are secured to said first package.

18. A piggy-back double packaging carton according to claim 14, wherein a tip portion of at least two of the tab means is further bent at right angles to overlie and be secured to the first package to hold the first package tightly against the second package.

19. A piggy-back double packaging carton according to claim 12, wherein a tip portion of at least two of the tab means is further bent at right angles to overlie and be secured to the first package to hold the first package tightly against the second package.

20. A piggy-back packaging carton blank for a basketball backboard and rim comprising:

a flat rectangular shaped carton blank having two parallel long sides and two parallel short sides;

said flat rectangular carton blank being large enough to be wrapped about a basketball backboard;

at least two score lines on said blank to define tab means which can be folded 90° outwardly of the blank to provide securement for a basketball rim package on said blank;

said tab means being located on the blank to define a location for said securement which is located off-center of the blank, between a center line of the blank and one side of the blank; and wherein said score lines are Y-shaped.

21. A piggy-back packaging carton blank for a basketball backboard and rim comprising:

a flat rectangular shaped carton blank having two parallel long sides and two parallel short sides;

said flat rectangular carton blank being large enough to be wrapped about a basketball backboard;

at least two score lines on said blank to define tab means which can be folded 90° outwardly of the blank to provide securement for a basketball rim package on said blank;

said tab means being located on the blank to define a location for said securement which is located off-center of the blank, between a center line of the blank and one side of the blank; and wherein said score lines are swastika-shaped.

22. A piggy-back double packaging carton with a basketball backboard and rim comprising:

a first small package housing the basketball rim therein;

a second larger package housing the basketball backboard therein;

a plurality of tab means, extending outwardly from the second package, for physically securing the first package onto the second package adjacent to one end of the second package;

a first of said tab means being located adjacent a mid-portion of said second package and being closer to said one end of the second package than to an end side parallel to said one end.

23. A piggy-back double packaging carton according to claim 22, wherein a second of said tab means is located adjacent to and spaced from said first end of said second package and opposite said first tab means; and said first package being located between said first and second tab means and secured thereto.

24. A piggy-back double packaging carton according to claim 23, wherein the tab means are integral with and a physical part of the second package.

25. A piggy-back double packaging carton according to claim 23, wherein third and fourth spaced and opposed tab means are provided and are secured to said first package.

* * * * *